US011735863B2

(12) United States Patent
Harmelink et al.

(10) Patent No.: US 11,735,863 B2
(45) Date of Patent: Aug. 22, 2023

(54) ELECTRICAL CONNECTOR WITH AUTOMATIC LATCHING AND SLIDABLE LOCK

(71) Applicant: Deere & Company, Moline, IL (US)

(72) Inventors: Gregory K. Harmelink, Moorhead, MN (US); Patrick R. Brandt, West Fargo, ND (US); Vince Segal, Fargo, ND (US); Antoine P. Duval, Fargo, ND (US); Jay A. Mosbrucker, West Fargo, ND (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 17/643,885

(22) Filed: Dec. 13, 2021

(65) Prior Publication Data

US 2023/0124805 A1 Apr. 20, 2023

Related U.S. Application Data

(60) Provisional application No. 63/262,705, filed on Oct. 19, 2021.

(51) Int. Cl.
*H01R 13/447* (2006.01)
*H01R 13/627* (2006.01)
(Continued)

(52) U.S. Cl.
CPC ..... *H01R 13/6275* (2013.01); *H01R 13/447* (2013.01); *H01R 13/639* (2013.01); *H01R 13/5213* (2013.01); *H01R 2201/26* (2013.01)

(58) Field of Classification Search
CPC ..... H01R 13/6275; H01R 13/447; H01R 13/639; H01R 13/5213; H01R 2201/26
See application file for complete search history.

(56) References Cited

U.S. PATENT DOCUMENTS 5,747,739 A * 5/1998 Moeller ..... H01R 13/6395 174/67
6,827,594 B1 * 12/2004 Davis ..... H01R 13/62933 439/157

(Continued)

FOREIGN PATENT DOCUMENTS

DE 19832181 A1 1/2000
DE 202009002880 U1 7/2010
EP 3249756 A1 11/2017

OTHER PUBLICATIONS

Extended European Search Report and Written Opinion issued in European Patent Application No. 22197607.9, dated Mar. 7, 2023, in 14 pages.

*Primary Examiner* — Tho D Ta

(57) ABSTRACT

An electrical connector comprises a housing body with a peripheral region and a central region. A hinge support protrudes from the housing body. A curved wall portion extends outward from the central region. A lid has a hollow portion arranged for rotation with respect to the hinge support. A spring or resilient member is configured to bias the lid in a closed state against an electrical socket with one or more electrically conductive terminals in an interior of the electrical socket. A slider is arranged to slide radially along the curved wall portion between an open position and a closed position, where the closed position holds the lid in the closed state and where the open position allows the lid to be rotationally raised or flipped upward.

11 Claims, 10 Drawing Sheets

(51) Int. Cl.
*H01R 13/639* (2006.01)
*H01R 13/52* (2006.01)

(56) References Cited

U.S. PATENT DOCUMENTS

| | | | | |
|---|---|---|---|---|
| 8,357,852 | B2 * | 1/2013 | Drane | H05K 5/03 174/67 |
| 8,888,515 | B2 * | 11/2014 | Hachadorian | H01R 13/447 439/142 |
| 9,093,777 | B2 * | 7/2015 | Kojima | H01R 13/5213 |
| 9,147,960 | B2 * | 9/2015 | Kojima | H01R 13/453 |
| 9,184,532 | B2 * | 11/2015 | Crovetti | H01R 13/62955 |
| 9,243,436 | B2 * | 1/2016 | Sawada | F16F 1/123 |
| 9,543,719 | B2 | 1/2017 | Bartholomew et al. | |
| 9,806,478 | B2 | 10/2017 | Bartholomew et al. | |
| 10,326,236 | B1 | 6/2019 | Harmelink et al. | |
| 10,707,611 | B2 | 7/2020 | Harmelink et al. | |
| 2004/0259397 | A1 | 12/2004 | Davis et al. | |
| 2019/0267741 | A1 * | 8/2019 | Sawada | B60R 16/04 |

* cited by examiner

ELECTRICAL CONNECTOR WITH AUTOMATIC LATCHING AND SLIDABLE LOCK

RELATED APPLICATION

This document (including the drawings) claims priority and the benefit of the filing date based on U.S. provisional application No. 63/262,705, filed Oct. 18, 2021, and entitled ELECTRICAL CONNECTOR WITH AUTOMATIC LATCHING AND SLIDABLE LOCK under 35 U.S.C. § 119 (e), where the provisional application is hereby incorporated by reference herein.

FIELD

This disclosure relates to an electrical connector, for a vehicle, with automatic latching and a slidable lock.

BACKGROUND

In the prior art, an implement bus breakaway connector (IBBC) is used for off-road equipment. For example, the IBBC can support electrical connections for between a tractor and an implement via an implement cable that terminates in a mating member (e.g., electrical plug). The electrical connector is typically mounted on the tractor or other propulsion unit via a standard mounting configuration, such as the ISO 11783-2 (ISOBUS standard). If the operator forgets to unplug the mating member from the electrical connector while separating the tractor and the implement, the break-away feature allows the controlled disconnection between the mating member and the electrical connector without damaging the cable or connector. The conventional IBBC supports a vehicle data bus, such as a controller area network (CAN) data bus with several conductors. However, the conventional IBBC may not support automatic latching or locking of the mating member to the connector.

SUMMARY

In accordance with one embodiment, an electrical connector comprises a housing body with a peripheral region and a central region. A hinge support protrudes from the housing body. A curved wall portion extends outward from the central region. A lid has a hollow cylindrical portion arranged for rotation with respect to the hinge support. A spring or resilient member is configured to bias the lid in a closed state against an electrical socket with one or more electrically conductive terminals in an interior of the electrical socket. A slider is arranged to slide radially along the curved wall portion between an open position and a closed position, where the closed position holds the lid in the closed state and where the open position allows the lid to be raised, lifted, or flipped.

DETAILED DESCRIPTION

Figure 1:
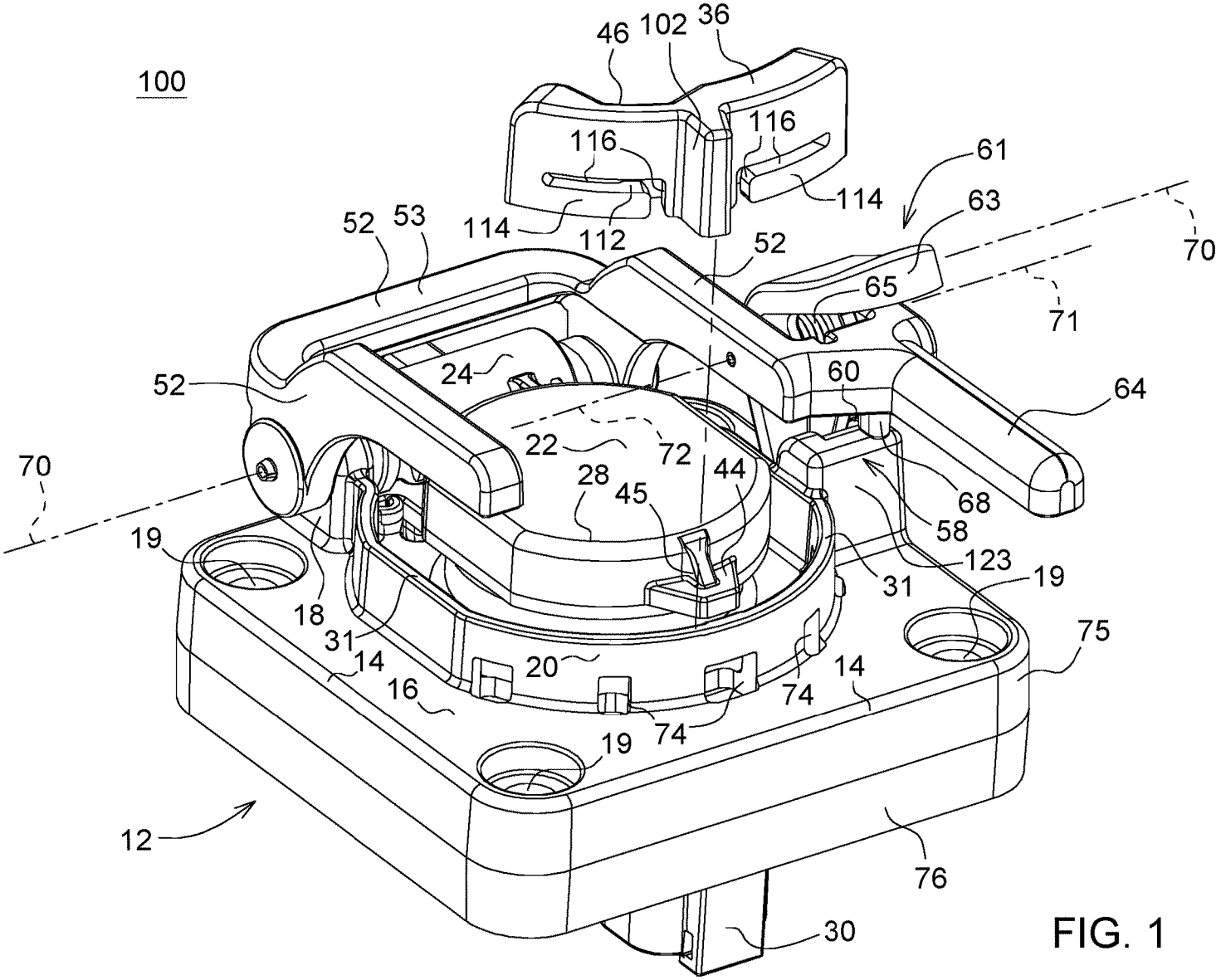
FIG. 1 is a top perspective view of an outer side of the electrical connector with the slider removed.

In accordance with one embodiment, in FIG. 1 an electrical connector 100 comprises a housing body 12 with a peripheral region 14 and a central region 16 with an opening 119 (e.g., for an electrical socket 30). A hinge support 18 protrudes (outward) from the housing body 12. A lid 22 has a hollow portion 24 (e.g., generally cylindrical hollow portion) arranged for rotation with respect to the hinge support 18. A spring 26 or resilient member is configured to bias the lid 22 in a closed state 28 against an electrical socket 30 with one or more electrically conductive terminals 32 in an interior 34 of the electrical socket 30. A curved wall portion 20 extends outward from a central region 16; the curved wall portion 20 may be associated with additional segments 31 (e.g., curved or linear segments) that partially or completely surround a perimeter of a lid 22. A slider 36 is arranged to slide radially along the curved wall portion 20 between an open position 38 and a closed position 40, where the closed position 40 holds the lid 22 in a closed state 28 and where the open position 38 allows the lid 22 to be rotated and raised (e.g., capable of being lifted or flipped open).

In one configuration, the housing body 12 comprises a first housing member 75 and a second housing member 76 that are joined (e.g., bonded, fastened, welded, fused or otherwise mechanically joined) to form a dielectric enclosure to house or protect an electrical socket 30. The housing body 12 can be made or formed by injection molding of plastic, a polymer, fiber-filled plastic, a fiber-filled polymer, a plastic matrix that binds of filler, or a polymer matrix that binds a filler. The filler or fiber may comprise glass fiber, carbon fiber, ceramic fiber, glass filler, or other filler.

Figure 2:
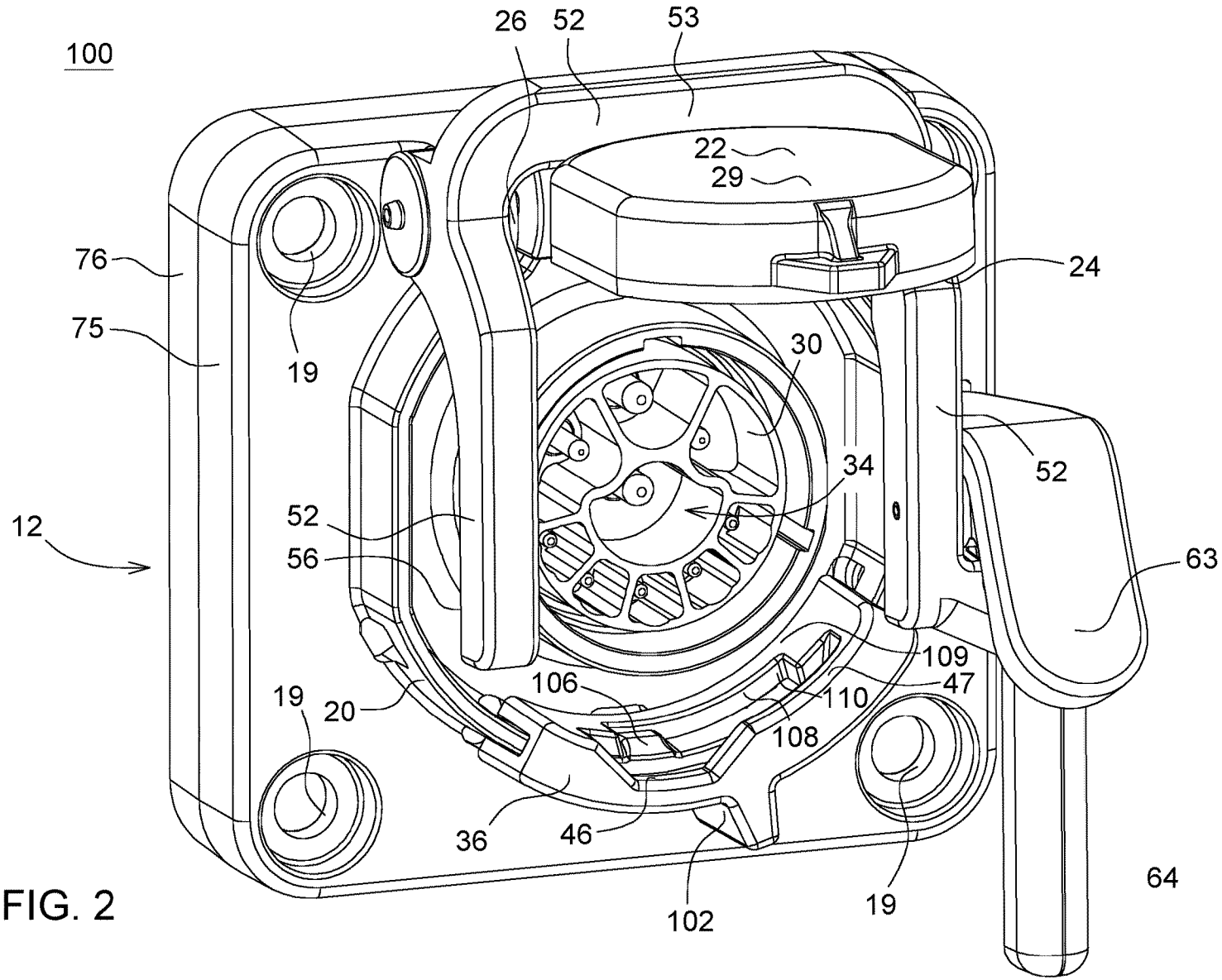
FIG. 2 shows a perspective view of the outer side or implement side of the electrical connector of FIG. 1 with an opened lid that can cover the electrical socket and the slider installed.

In one embodiment, the electrical socket 30 comprises electrically conductive terminals 32 (e.g., pins in FIG. 2) separated by dielectric supporting structure with one or more walls of an interior 34 of the electrical socket 30. In one embodiment, the electrically conductive terminals 32 may be mounted on and extend from a circuit board through the dielectric supporting structure, while in other embodiments, the conductive terminals 32 may be mechanically and electrically conducted to conductors, wires, cables, twisted pairs of wires, or the like.

In one embodiment, a hinge support 18 protrudes from the housing body 12 near or below a first edge (e.g., upper edge) of the housing body 12. Further, the first edge of the housing body 12 is located opposite a second edge (e.g., lower edge).

In one configuration, a curved wall portion 20 extends outward from the central region 16. For example, a curved wall portion 20 extends outward from the central region 16 near or above the second edge (e.g., lower edge.) Further, the curved wall portion 20 may adjoin additional wall portions 31 that are curved or straight and surround, at least partially, the lid 22.

A lid 22 has a hollow portion 24 arranged for rotation with respect to the hinge support 18, where the hollow portion 24 may house or contain a spring 26 that: (a) biases the lid in a closed state 28, (b) biases an arm 52 rotationally toward the housing body 12, or (c) both. For example, a lid 22 has a hollow portion 24 (e.g., hollow cylindrical portion) arranged for rotation with respect to the hinge support 18 via shaft along an arm rotational axis 70. Further, the lid and the arm each can rotate independently with respect to the arm rotational axis 70 that extends through the hinge support 18, coextensively with a first bore in the hinge support 18 and a second bore of the hollow cylindrical portion 24. The lid 22 has a radially outward extending tab 44 (e.g., at its bottom), which engages with a radially inward extending lip 47 of the slider 36 to attain any of the following: (a) the locked position (e.g., of angular rotation along an arc path) of the slider 36, (b) the closed state 28 of the lid 22, and (c) the locked state of the slider 36, the lid 22, or both. Conversely, the lid 22 has a radially outward extending tab 44 (at its bottom), which is aligned with a corresponding opening or recess 46 in the radially extending lip of the slider 36 to attain any of the following: (a) an open position or unlocked position (e.g., of angular rotation along an arc path) of the slider 36, (b) an open state 29 or openable of the lid 22, and (c) an unlocked state of slider 36, the lid 22, or both.

A spring 26 comprises a resilient member for biasing the lid 22 in a closed state 28 against an electrical socket 30 with one or more terminals 32 in an interior 34 of the electrical socket 30.

A slider 36 is arranged to slide 22 radially along the curved wall portion 20 between an open position 38 and a closed position 40 where the closed position 40 holds the lid 22 in the closed state 28 and where the open position 38 allows the lid 22 to be rotationally raised or flipped open in an openable state (e.g., without mechanical interference). In one embodiment, a closed position 40 of the slider 36 means the slider 36 is at a first angular rotation of the slider 36 about the central axis 104; an open position 38 means the slider 36 is at a second angular rotation of the slider 36 about the central axis 104, where that the second angular rotation is different than the first angular rotation about the central axis 104.

The slider 36 has a grip portion 102 extending outward for a user to grasp (e.g., with or between one or more fingers or digits). For example, the grip portion 102 may extend radially outward from a central axis 104 of the connector 100. The slider 36 is movably or slidably retained on the curved wall portion 20 with one or more snap-fit connectors, such as a snap-fit protrusion 106 (in FIG. 2) or snap-fit tooth that retains a lower annular portion 108 of the inner annular portion 109 of the slider 36 that can deform (e.g., elastically deform) over the snap-fit protrusion 106 or snap-fit tooth. As illustrated, the snap-fit protrusion 106 retains the slider 36 in movable or slidable state along an arc path (e.g., with respect to the curved wall portion 20).

Figure 6:
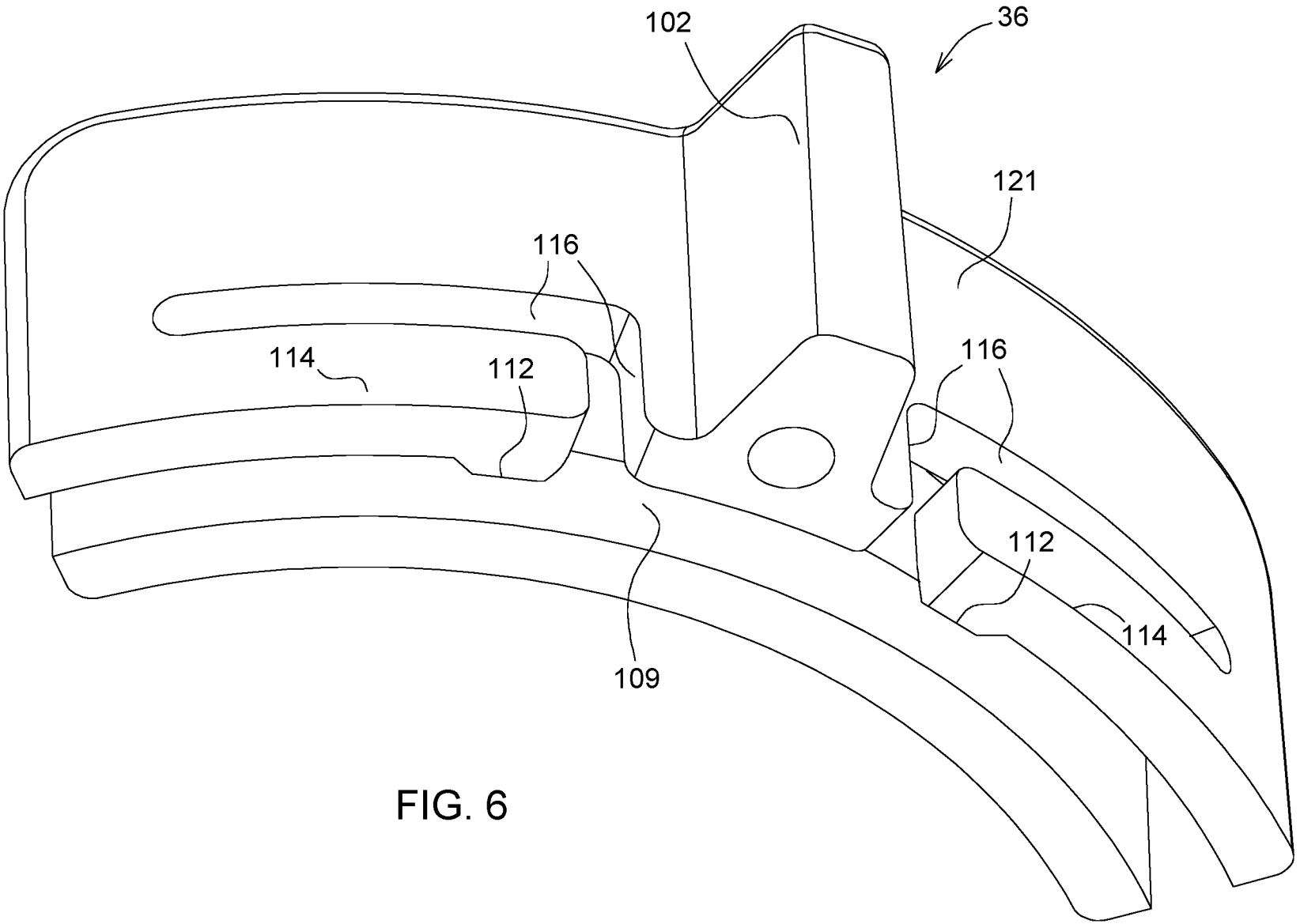
FIG. 6 shows a perspective view of the slider removed from the electrical connector of FIG. 1.
Figure 7:
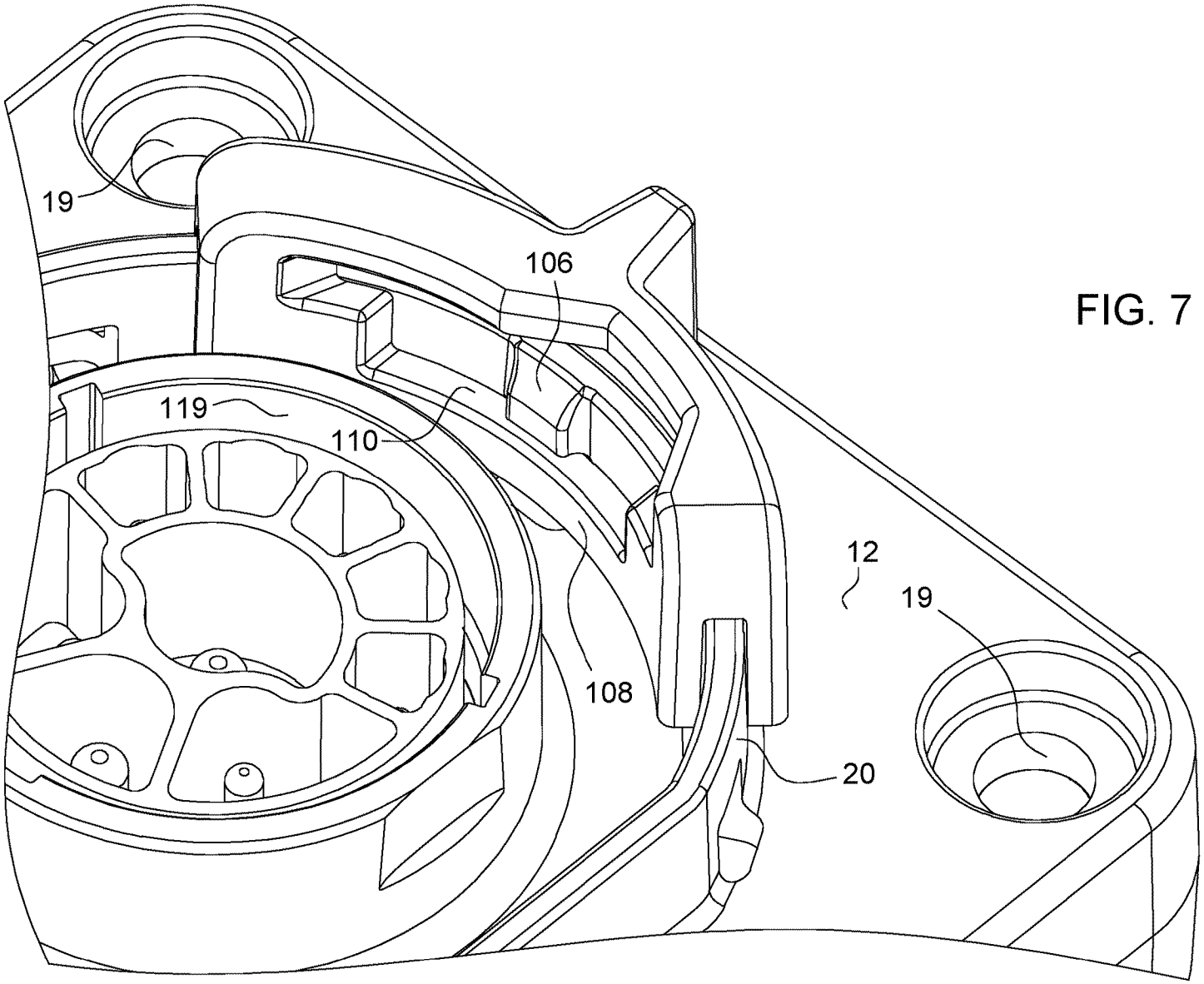
FIG. 7 shows a perspective view of the slider installed on the curved wall portion and retained by the snap-fit protrusion or snap-fit tooth, where the electrical socket is removed from the electrical connector.

The snap-fit protrusion 106 is disposed in a recess 110 or notch in the inner annular portion 109 of the slider 36 that defines one or more limits of movement or sliding when the snap-fit protrusion 106 contacts the lateral edges of the recess 110 or notch in the inner annular portion of the slider. Further, the slider 36 has one or more protrusions 112 (e.g., snap-fit protrusions) that engage detent recesses (72, 74) or catches on the curved wall portion 20 to releasably hold the slider 36 in a closed position 40 or an open position 38 at different times or mutually exclusive times. Each protrusion 112 may comprise a male termination of an annular snap-fit arm 114 that is flexible or elastically deformable, where the annular snap-fit arm 114 is defined by an outer annular portion 121 of the slider that is parallel to an inner annular portion 109 of the slider with the recess. As illustrated in FIG. 6, the snap-fit arm 114 is defined by an opening 116, such as an L-shaped opening 116 a bottom edge of the outer annular portion 121 of the slider 36.

The slider 36 has an inner annular portion 109 with an annular recess 110 that engages a snap-fit protrusion 106 (e.g., snap-fit tooth) in the curved wall portion 20 to retain the slider 36 in a slidable or movable state. In one embodiment, the slider 36 comprises snap-fit arms 114 that terminate in snap-fit protrusions 112. The snap-fit arms 114 are defined by openings 116 in an outer annular portion 121 of the slider 36. For example, the slider 36, or the lid 22, or both may have several states that are mutually exclusive, such as a locked state, a transient state, and a locked state. In a locked state, the snap-fit protrusions 112 engage corresponding first detent recesses 74 in the curved wall portion. In a transient state, the snap-fit protrusions 112 are elastically deformed and biased against the curved wall portion 20 between the first detent recesses 74 and second detent recesses 72 in the curved wall portion. In an unlocked state, the snap-fit protrusions 112 engage corresponding second detent recesses 72 in the curved wall portion, the corresponding second detent recesses 72 spaced apart from the first detent recesses 74. In one configuration, the slider 36 has a grip portion 102 for moving or sliding the slider 36; hence, the lid 22, with respect to the curved wall 20 between a locked state and an unlocked state.

Figure 8:
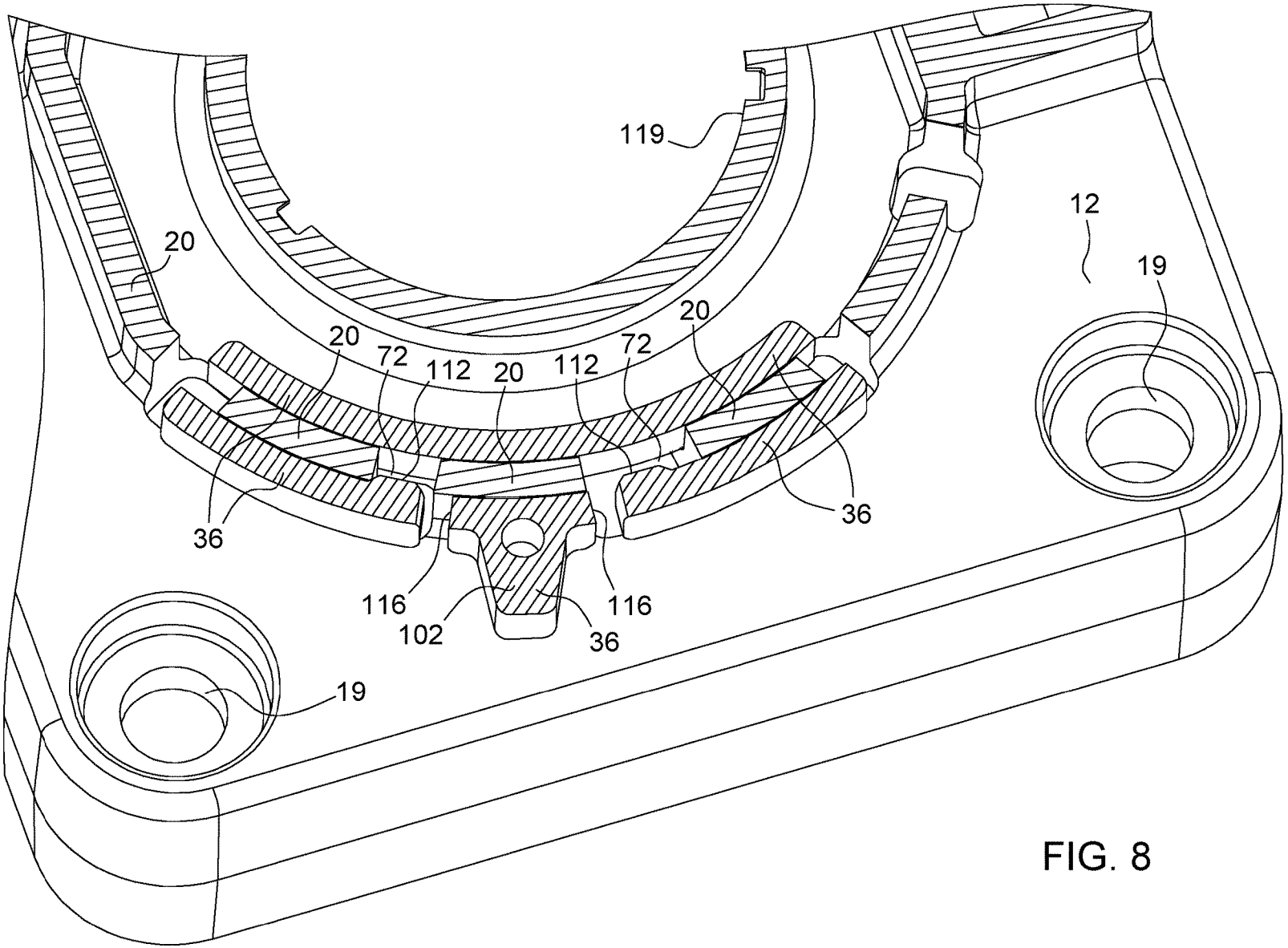
FIG. 8 shows a perspective view of a cross-section of the slider and curved wall portion, where the slider is an unlocked state (and unlocked position) with respect to curved wall portion of the electrical connector.
Figure 9:
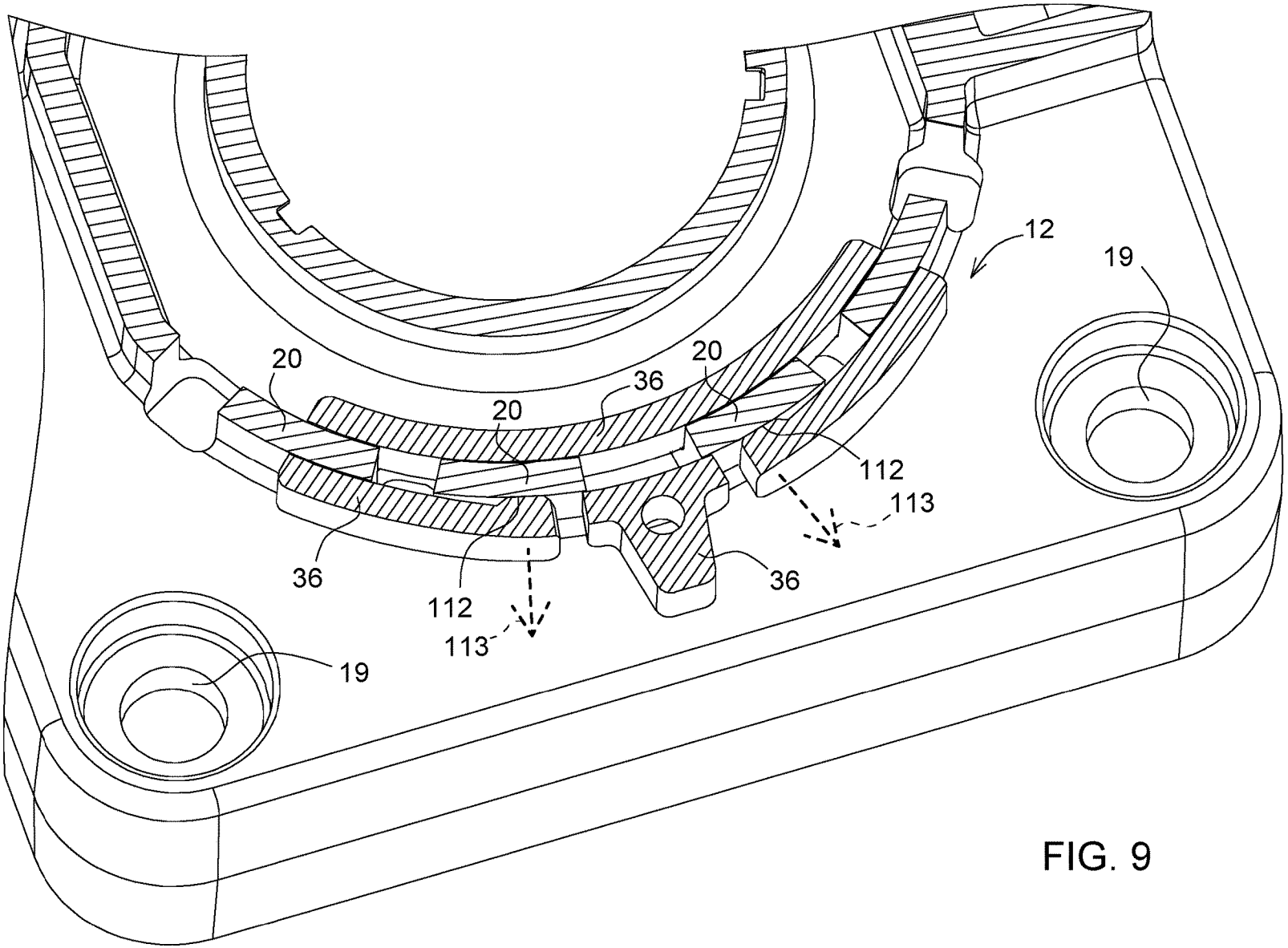
FIG. 9 shows a perspective view of a cross-section of the slider and curved wall portion, where the slider is a transient state or intermediate state between a locked position and an unlocked position of the slider with respect to the curved wall portion.

A protrusion 112 (e.g., second protrusion) or male termination may engage a corresponding second detent recess 72, second catch or slot in the curved wall to retain the slider 36 in an unlocked position. Similarly, a pair of protrusions 112 (e.g., second protrusions) may engage a corresponding pair of second detent recesses 72, catches or slots in the curved wall to retain the slider 36 in an unlocked state of FIG. 8. In contrast, the protrusion 112 or male termination is deformed and pressed away from the curved wall 20 (and not engaging any detent recess (72, 74), catch or slot) during a transition state between a locked and unlocated state 48 of the slider 36. A protrusion 112 (e.g., first protrusion) or male termination may engage a corresponding first detent recess 74, first catch or slot in the curved wall 20 to retain the slider 36 in an unlocked position. Similarly, a pair of first protrusions 112 may engage a corresponding pair of first detent recesses 74, catches or slots in the curved wall to retain the slider 36 in an unlocked state of FIG. 8.

Figure 10:
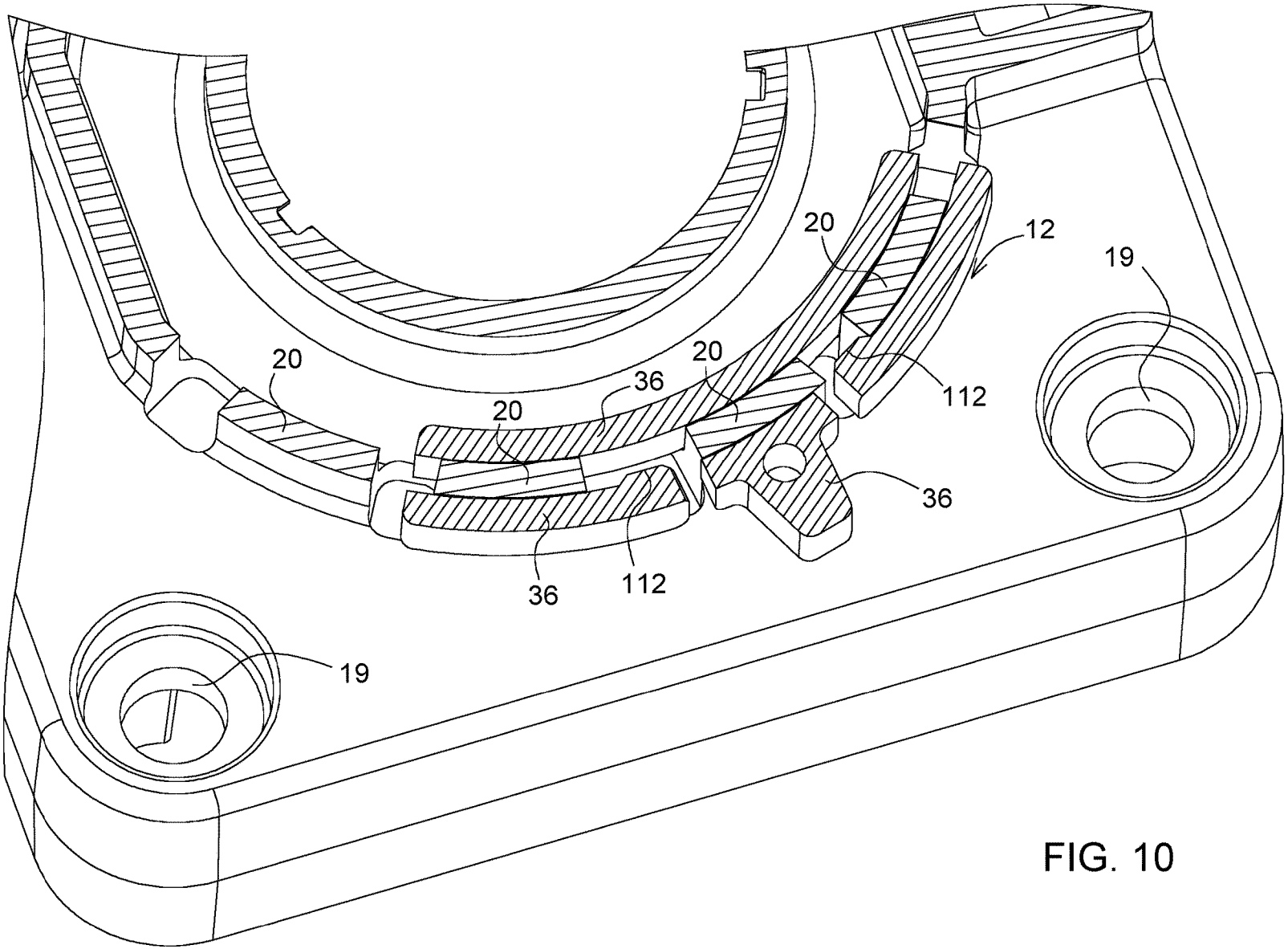
FIG. 10 shows a perspective view of a cross-section of the slider and curved wall portion, where the slider is a locked state (and locked position) with respect to the curved wall portion.

The lid 22 has a radially outward extending tab 44 (at its bottom), which engages with a radially inward extending lip 47 of the slider 36 to attain the closed position 40 of the slider 36 and the locked state 48 of the lid 22 of FIG. 10. The lid 22 has a radially outward extending tab 44 (at its bottom), which is aligned with a corresponding opening or recess 46 in the radially extending lip of the slider 36 to attain an open position 38 of the slider 36 and an unlocked state of FIG. 8 of the lid 22. The tab 44 may be associated with a tab brace 45 (e.g., to reinforce the tab 44 with respect to any opening forces applied to the lid 22).

The electrical connector 100 has an arm 52, such as yoke or U-shaped member, that is rotatable about the hinge support 18 along arm rotational axis 70. In one embodiment, the arm 52 comprises retaining members 56 that that extend from a transverse portion 53 of the arm 52. Further, the arm 52 is biased in a retention state toward or against a housing body 12 or to retain (e.g., and toward) an electrical plug 54 that is mated with the electrical socket 30, such that the retaining members hold the electrical plug 54 and electrical socket 30 in a removable/releasable mated position. For example, arm 52 is biased in a retention state toward or against a housing body 12, where retaining members 56 of the arm 52 have contact portions that seat against an electrical plug 54 or that retain removably an electrical plug 54 that is mated with the electrical socket 30. The retaining members 56 hold the electrical plug 54 and electrical socket 30 together in a removable or releasable mated position in accordance with an automatic (e.g., break-away) disconnect mechanism, when the electrical plug 54 and the electrical socket 30 are not manually disconnected by a person or operator (e.g., of a tractor with an implement that uses the electrical connector 100 to provide electrical service, data transmission or electrical signaling between a tractor and a towed implement).

A rotatable member 61, which is rotatable about release rotational axis 71, is disposed on the arm 52 or one of its retaining members 56. The rotatable member 61 terminates a hook 60 or mating interface at a first end and a release lever 63 at a second end that is opposite the first end. The hook 60 or mating interface or rotatable member 61 is arranged to engaging a catch extending above the body 12, where the catch may be formed by a recess in a protrusion 123 extending above the body 12. In one embodiment, a latch 58 is formed by the rotatable member 61, the release lever 63 and the catch in the protrusion 123. There may be a stop or pedestal 68 extending downward from the release lever 63 or an optional primary lever 64 that is an extension of the arm 52. The stop or pedestal 68 can rest on the protrusion 123 with the recess.

In one embodiment, a latch 58 is on the arm 52, the latch 58 comprises a rotatable hooked member 60 for engaging a catch extending above the body 12 to prevent the electrical plug from being removed from the electrical socket until a threshold force is applied directly, actively to the rotatable hooked member via an lever or indirectly, passively via the electrical plug 54 and an contacting portion of the retaining members 56 or lever, or both. For example, the hook 60 or mating interface and recess may have sloped or angled surfaces such that latch 58 will release if an applied for that is equal to or greater than a threshold force is applied upward on a primary lever 64 or if downward force 113 is applied to the rotate the release lever 63 downward toward the primary lever 64. For instance, the latch 58 releasing means that the hook 60 or mating surface is released from the catch to free the arm 52 and its retaining members 56 from seating against or retaining an electrical plug 54 inserted into the electrical socket 30 within the body of the electrical connector 100.

Figure 3:
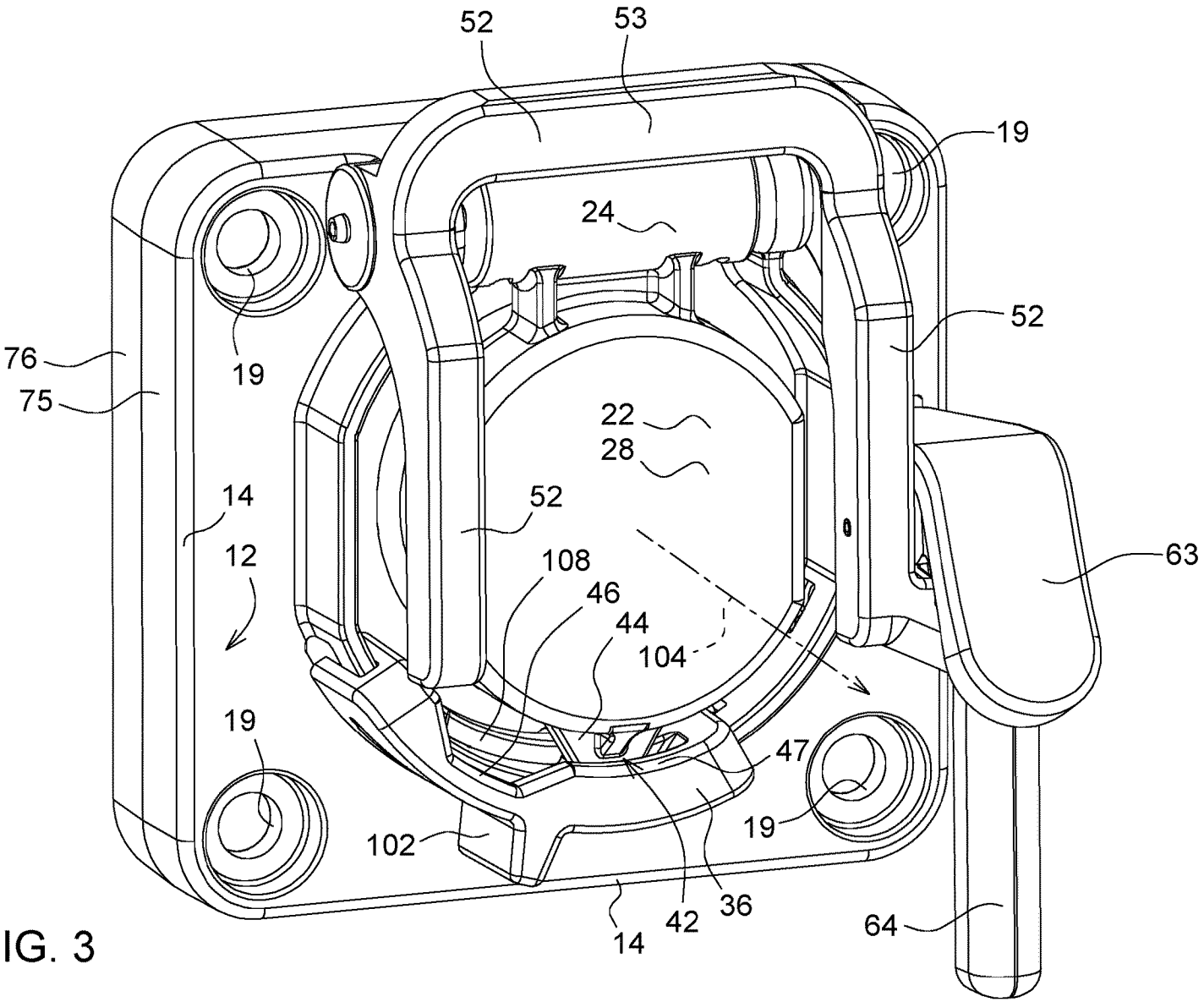
FIG. 3 shows a perspective view of an outer side of the assembled electrical connector of FIG. 1 with the slider in the locked position such that the lid is in a locked state.
Figure 4:
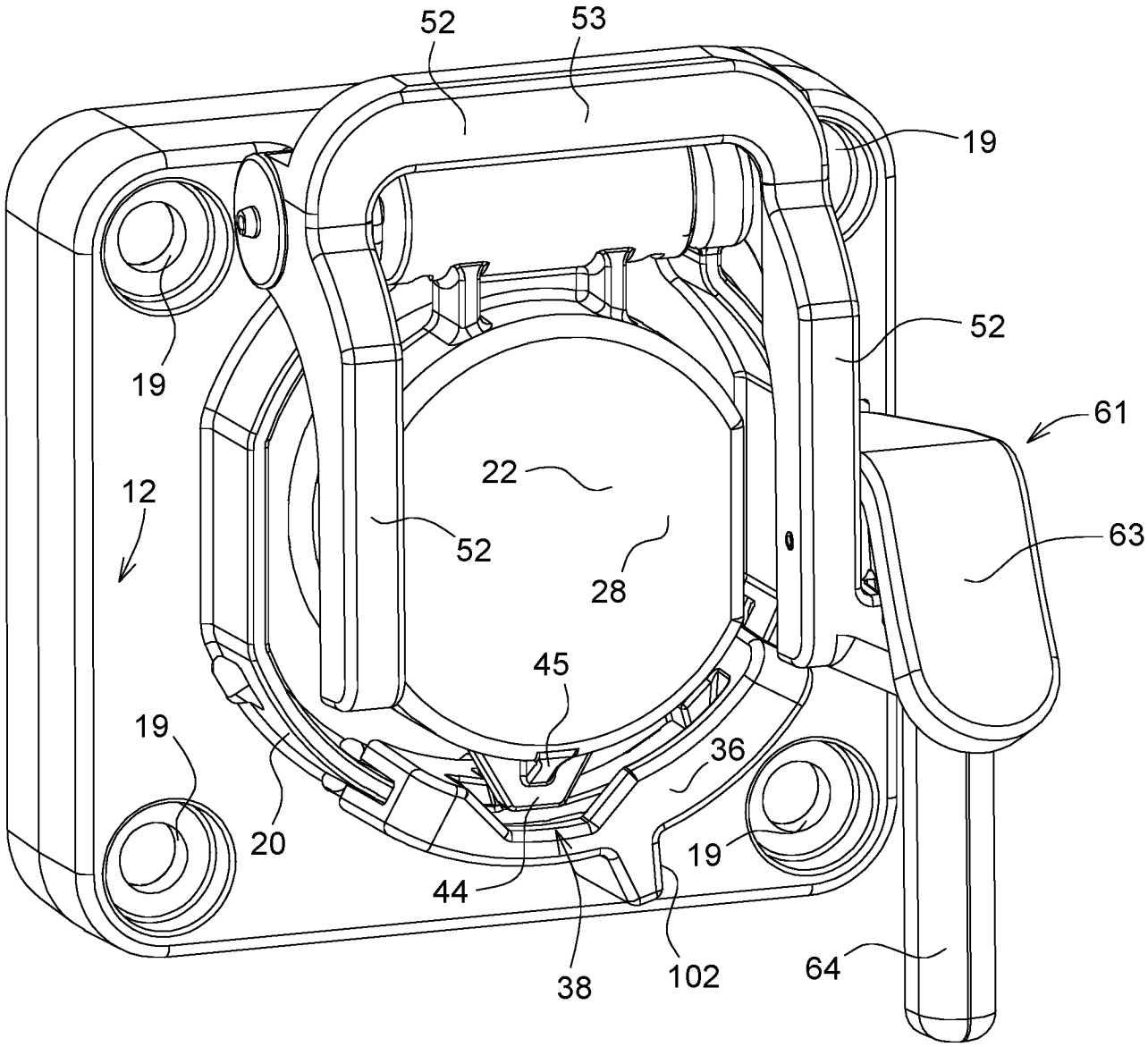
FIG. 4 shows a perspective view of an outer side of the assembled electrical connector of FIG. 1 with the slider in the unlocked position such that the lid is in an unlocked state or openable state.
Figure 5:
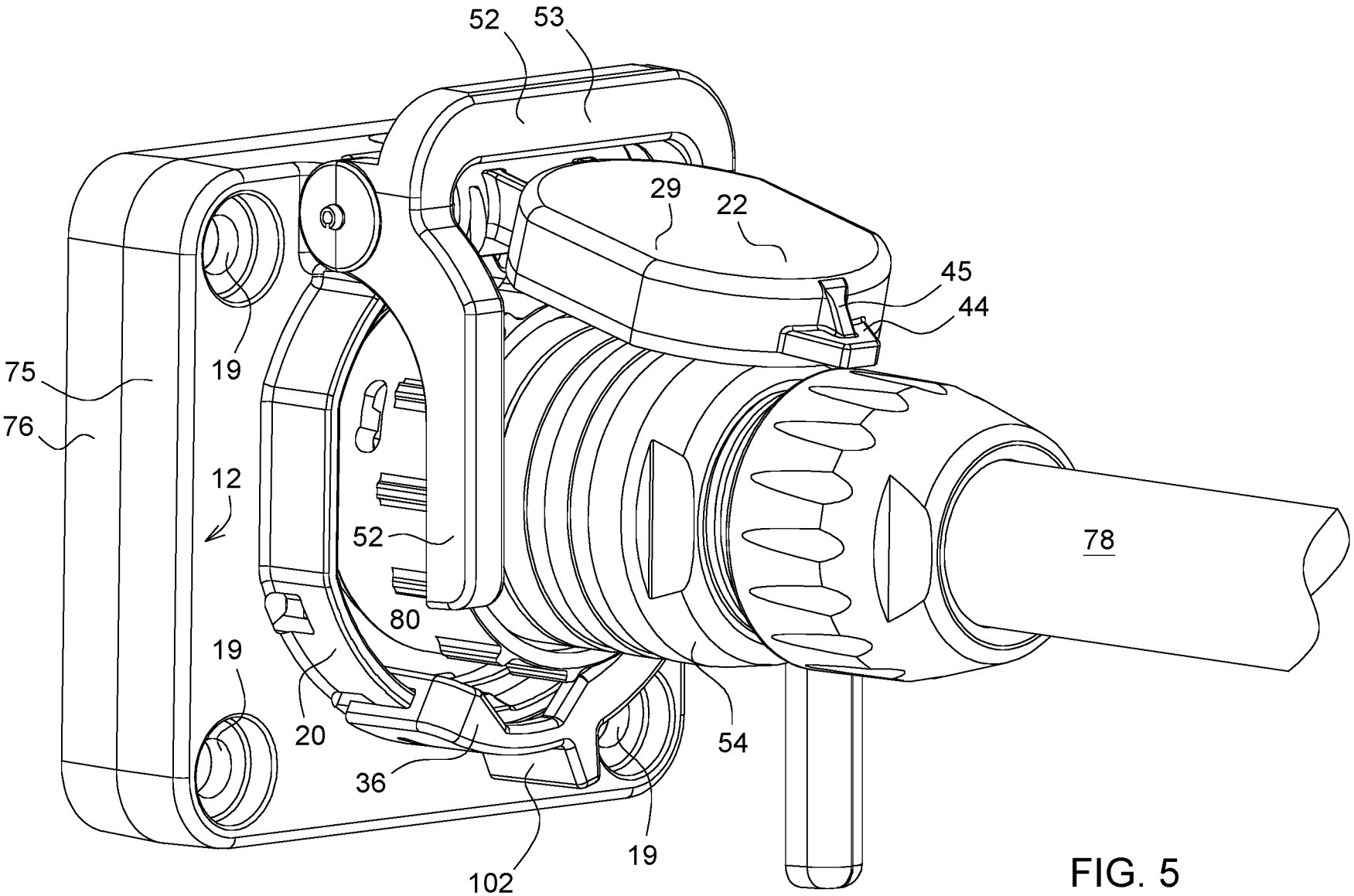
FIG. 5 shows a perspective view of an outer side of the assembled electrical connector of FIG. 1 with the socket mated with the plug that is removably, releasably retained by the arm.

In one configuration, the latch 58 prevents the electrical plug 54 from being removed from the electrical socket 30 until a threshold force (e.g., outward from or normal to the electrical connector 100, such as along central axis 104 of FIG. 3) is applied in accordance one or more of the following ways: (a) directly, actively (e.g., by a user) to the optional primary lever 64 by lifting the optional primary lever 64; (b) indirectly, passively via the electrical plug 54 applying an outward force from the connector body that opposes the biasing force of any spring 26 at the contacting portion 62 of the retaining members 56; (c) the electrical plug 54 applying an outward force from the connector body, which opposes the biasing any spring 26 at the contacting portion 62 of the retaining members 56, that, in turn, causes an upper contacting portion 62 of the optional primary lever 64 to apply the upward force to the lower contacting portion 62 of the rotatable member 61; (d) direct actively (e.g., by a user) by pushing downward on the release lever 63 or latch 58 to release the hook 60 or mating interface from the catch.

Normally Closed and Sealed State

In one embodiment, the electrical connector 100 has several states, such as a normally closed and sealed state for the first lid 22. The normally closed and sealed state refers to a state in which the mating connector portion (e.g., plug 54 or male portion of the electrical connector 100) is disconnected from the electrical socket 30 (e.g., female portion of the electrical connector 100). If the mating connector portion (e.g., plug 54) is disconnected or if the connector portion is not in use, then the lid 22 will be closed covering and sealing hermetically the connector opening of the socket 30 or an interior 34 of the socket 30, such as to protect the terminals 32 from corrosion, oxidation, dust, salt, contaminants, and debris. Similarly, if the mating connector (e.g., plug 54) is disconnected from the electrical socket 30, which supports an electrical and mechanical connection to electrical energy (e.g., direct current voltage or alternating current source), data port, CAN port, Ethernet port or USB port, then the lid 22 will be closed covering and sealing hermetically the connector opening or container to prevent the ingress of moisture, dirt, debris and contaminants.

The lid 22 is a cap or cover for protecting the electrical connector 100 or electrical socket 30 from the ingress of dirt, debris, contaminants, salt, corrosive chemicals, or moisture that might otherwise damage (e.g., corrode) the electrically conductive terminals 32 (e.g., conductor members) or interfere with a reliable electrical connection associated with the electrical connector 100 and a corresponding mating connector portion. If the lid 22 is closed, then the arm 52, which comprises a first arm 52 portion and a second arm 52 portion, latch or resiliently bias the lid 22 in the closed position 40, against an annular step 80, by notches, seating portions or hook 60 features with releasable latch 58.

Manual Release and Opening of Lid

If the user first presses (e.g., strikes) the release lever 63 (e.g., secondary lever 63) toward the lever 64 (e.g., primary lever) and secondly pulls upward on the arm 52, such as the first arm 52 portion and the second arm 52 portion, the arm 52 will move or rotate outwardly and unlatch allowing the lid 22 to be opened. If the lid 22 is opened sufficiently, then the user can manually insert the mating connector portion (e.g., electrical plug 54) of the electrical connector 100 into the connector portion or electrical socket 30 to form a reliable electrical and mechanical connection between the vehicle and an external cable 78 and connector portion (e.g., electrical plug 54 associated with an implement, such as a towed implement). In one illustrative example, the mating connector portion comprises an implement harness connector.

Manual Insertion of the Mating Implement Harness Connector

If the user holds the lid 22 or cover open with one hand and grasps the mating connector portion (e.g., plug 54 of the implement harness connector) with the other hand while pushing the mating connector portion end through the opening formed by the arm 52 (e.g., first arm portion and second arm portion, or collectively pawls), then the arm 52 will open to receive the mating connector portion (e.g., electrical plug 54). If the mating connector portion (e.g., electrical plug 54 or implement harness connector) pushes past the arm 52 to a fully seated condition, then the arm 52 will return to a rest position which that positively retains or latches the mating connector portion (e.g., plug 54) to the electrical connector 100 in the mated and sealed position, which can also be referred to as a connected state.

Manual Release of Implement Harness Connector

If the user grasps or pulls on the mating connector portion (e.g., electrical plug 54 or mated implement harness connector) and if the user presses (e.g., bumps) the release lever 63, simultaneously to with the hand (e.g., fingers or knuckles of his or her hand) in a connected state or latched state, then the arm 52 is freed to move outward and unlatch allowing the mating connector portion (e.g., electrical plug 54) to disconnect from the electrical connector 100. If or once the mating connector portion (e.g., electrical plug 54 or implement harness connecter) is manually released and removed, then the electrical connector 100 will automatically latch onto the lid 22 into a closed state 28.

Automatic Positive Latching

If the mating connector portion (e.g., electrical plug 54 or implement harness connector) is unmated and removed from the vehicle electrical connector 100, then the lid 22 or cover will automatically push past the arm 52 to close over top of the end of the step 80 or tubular portion of the electrical plug 54 or the vehicle connector opening or socket 30. If the lid 22 is closed completely, then the arm 52 will return to a rest position which positively retains or latches the lid 22 in the closed and sealed position to protect the socket 30 from ingress of moisture, debris, salt and contaminants, for example.

Break Away Release of Implement Harness Connector

If the mating connector portion (e.g., electrical plug 54 or the mated implement harness) is pulled away from the vehicle electrical connector 100 with sufficient force outward and normal to the connector 100, then the arm 52 will open releasing the mating connector portion (e.g., implement harness connector) without damage to the electrical connector 100 or the mating connector portion, or the mated implement cable 78 or wire harness.

Whenever the break-away release event occurs, then automatic latching will occur. The electrical connector 100 of the disclosure features a robust spring-loaded design to bias the arm 52 toward the plug 54 and the lid 22 toward the body 12 of the connector 100 to foster reliability and longevity. The electrical connector 100 is well suited for providing automatic latching of the lid 22 and automatic latching between the electrical connector 100 and mating connector portion, such as a plug 54 of an implement harness connector or data port connector. Accordingly, the automatic latching of the lid 22 protects the conductive members from damage, corrosion and the ingress of dirt and debris that might otherwise interfere with a reliable electrical connection between the electrical connector 100 and mating connector portion. The electrical connector 100 provides additional space that supports a high-speed data connection, such as Ethernet, two-wire Ethernet, four-wire Ethernet or USB.

The electrical connector comprises an ISOBUS Break-Away Connector design (IBBC). The slider and associated features are well suited for environmental sealing of the spring loaded lid (e.g., cover) when the ISOBUS mating connector (e.g., electrical plug) is not in place or mated (e.g., with the electrical socket in the connector housing). In one configuration, the curved wall portion, alone or together with additional wall portions, forms a barrier wall, such as curved wall, with drain holes; the barrier wall with drain holes (e.g., formed or molded as part of the connector housing) can protect the lid from being forcibly and unintentionally opened by water pressure during the high pressure water and detergent cleaning processes often used in the field on agricultural and heavy equipment.

Further, the barrier wall, such as curved wall, also acts as a support rail for an additional snap-on, hand activated, molded plastic, sliding lock mechanism with detents, which can be used to hold the lid in a tightly closed position and sealed against ingress to preserve the integrity of the IBBC connector module socket, such as protection against moisture, salt, corrosive liquids, fertilizer, pesticides, insecticides, fungicides or other chemicals. The curved sliding lock snaps into the barrier ring feature and travels along the trajectory of the ring to provide an open (unlocked) and closed (locked) operating position. Small features on the sliding lock drop into the drain hole cavities to create positive detents for locked and unlocked positions. Both the ring feature and sliding lock have sufficient clearance for the ISOBUS mating connection.

Having described the preferred embodiment, it will become apparent that various modifications can be made without departing from the scope of the invention as defined in the accompanying claims.

The following is claimed:

1. An electrical connector comprising:

a housing body with a peripheral region and a central region with an opening;

a hinge support protruding from the housing body;

a curved wall portion extending outward from the central region;

a lid having a hollow cylindrical portion arranged for rotation with respect to the hinge support;

a spring or resilient member for biasing the lid in a closed state against an electrical socket with one or more terminals in an interior of the electrical socket; and a slider arranged to slide radially along the curved wall portion between an open position and a closed position, where the closed position holds the lid in the closed state and where the open position allows the lid to be raised.

2. The electrical connector according to claim 1 wherein the lid has a radially outward extending tab, which engages with a radially inward extending lip of the slider to attain the closed position of the slider and a locked state of the lid.

3. The electrical connector according to claim 1 wherein the lid has a radially outward extending tab, which is aligned with a corresponding opening or recess in the radially extending lip of the slider to attain an open position of the slider and an unlocked state of the lid.

4. The electrical connector according to claim 1 wherein the connector has an arm that is rotatable about the hinge support with retaining members that that extend from a transverse portion of the arm, wherein the arm is biased in a closed state toward a housing body or toward an electrical plug that is mated with the electrical socket, such that the retaining members hold the electrical plug and electrical socket in a removable/releasable mated position.

5. The electrical connector according to claim 4 wherein a latch is on the arm, the latch comprising a rotatable hooked member for engaging a catch extending above the body to prevent the electrical plug from being removed from the electrical socket until a threshold force is applied directly, actively to the rotatable hooked member via an lever or indirectly, passively via the electrical plug and an contacting portion of the retaining members or lever, or both.

6. The electrical connector according to claim 1 wherein the slider has an annular portion that engages a snap-fit protrusion in the curved wall portion to retain the slider in a slidable or movable state.

7. The electrical connector according to claim 1 wherein the slider comprises snap-fit arms that terminate in snap-fit protrusions, where in a locked state the snap-fit protrusions engage corresponding first detent recesses in the curved wall portion.

8. The electrical connector according to claim 7 wherein in a transient state the snap-fit protrusions are elastically deformed and biased against the curved wall portion between the first detent recesses and second detent recesses in the curved wall portion.

9. The electrical connector according to claim 7 wherein the slider comprises snap-fit arms that terminate in snap-fit protrusions, where in unlocked state the snap-fit protrusions engage corresponding second detent recesses in the curved wall portion, the corresponding second detent recesses spaced apart from the first detent recesses.

10. The electrical connector according to claim 7 wherein the snap-fit arms are defined by openings in an outer annular portion of the slider.

11. The electrical connector according to claim 1 wherein the slider has a grip portion for moving or sliding the slider with respect to the curved wall between a locked state and an unlocked state.

* * * * *